US005511380A

United States Patent [19]

Ha

[11] Patent Number: 5,511,380

[45] Date of Patent: Apr. 30, 1996

[54] HIGH PURITY NITROGEN PRODUCTION AND INSTALLATION

[75] Inventor: Bao Ha, Vacaville, Calif.

[73] Assignee: Liquid Air Engineering Corporation, Houston, Tex.

[21] Appl. No.: 312,248

[22] Filed: Sep. 12, 1994

[51] Int. Cl.[6] ..... F25J 3/02

[52] U.S. Cl. ..... 62/646; 62/645

[58] Field of Search ..... 62/38, 24, 41

[56] References Cited

U.S. PATENT DOCUMENTS 5,255,524 10/1993 Agrawal et al. ..... 62/24

5,331,818 7/1994 Rathbone ..... 62/24

5,373,699 12/1994 Gastinne et al. ..... 62/38

*Primary Examiner*—Ronald C. Capossela

*Attorney, Agent, or Firm*—Robert D. Touslee

[57] ABSTRACT

Ultra-pure nitrogen is produced in a process comprising separating air in an integrated plurality of columns. A nitrogen-enriched stream is elevated in pressure and thereafter contaminants and impurities are removed in an auxiliary column system which allows for the main column to efficiently operate below the required nitrogen product pressure, while including an ability to optionally obtain a normal purity nitrogen and a liquid nitrogen product. The process and installation remains efficient and economical in a relatively small scale installation to produce extremely pure nitrogen product.

20 Claims, 2 Drawing Sheets

HIGH PURITY NITROGEN PRODUCTION AND INSTALLATION

BACKGROUND OF THE INVENTION

The present invention relates to a process for the production of at least one nitrogen product having an extremely low level of detectable contaminants and impurities, or an "ultra-pure" nitrogen product.

Variations on traditionally available air separation processes to make high purity nitrogen have been proposed to reduce levels of impurities, such as hydrogen, helium, oxygen, carbon monoxide, hydrocarbons and neon, as concentrations of these constituents in cooled and dried feed air may be as high as 20 ppm. Some of these processes have been successful to reduce impurities in the nitrogen product to low levels.

The semiconductor industry in particular demands levels of contaminants and impurities in process gases to be maintained at an extremely low level, often required to be maintained at or below 10 ppb. Together with the ultra-pure nitrogen requirement, often at the same or nearby facility a gas consumer may have requirements for nitrogen gas of more normal purity, and the relative as well as total volumes required may vary from time to time. These and other factors require new and improved cost-sensitive and flexible processes for separating air into nitrogen products of varying purity, including production of extremely ultra-pure nitrogen.

U.S. Pat. No. 5,218,825 discloses a process for producing both a normal purity and a high purity nitrogen product. Air is compressed, cooled and flowed to a main column operating at or near nitrogen product pressure, wherefrom a nitrogen-enriched stream is withdrawn and a normal purity nitrogen product is taken prior to the nitrogen-enriched stream being increased in pressure and returned to the main column, following expansion, as reflux. According to the process described, a side rectification column takes a feed from the stripping section of the main column and a high purity nitrogen product is produced in the upper portion of the side rectification column. The process utilizes expansion of the oxygen-enriched stream from the bottom of the main column to condense vapors at the top of the main air separation column.

U.S. Pat. No. 5,123,947 discloses a multi-column cryogenic air distillation where ultra-high purity nitrogen, defined as typically less than 0.1 ppm impurities is produced from a nitrogen-rich stream withdrawn from a first column and fed to a second column. The process describes purging a portion of uncondensed vapor produced from the top of a second column, and recovering the ultra-high purity nitrogen product at a point below the purge point in the second column.

U.S. Pat. No. 4,902,321 discloses a process for the production of high purity nitrogen comprising partial condensation of a nitrogen rich vapor stream containing light impurities withdrawn from a main cryogenic air distillation column by indirect heat exchanger with the expanded condensate in a heat exchanger.

In U.S. Pat. No. 5,325,674 a process is disclosed for producing high purity nitrogen comprising expanding a dried and cooled feed air stream into a first air separation column to produce a nitrogen-enriched stream at the top of the column. Also disclosed is the flowing of recycled nitrogen at an elevated pressure through a reboiler located in the lower portion of a second column to provide boil-up, and thereafter flowed into the upper portion of the second column, to produce at the top of the second column vapors containing light impurities which vapors after at least partially condensing in a condenser located in the lower portion of the air separation column, are purged from the second column. High purity nitrogen is produced from the lower portion of the second column.

EP 0 376 465 A1 discloses a method of purifying nitrogen from an air separation process and producing an high purity nitrogen product by charging a nitrogen-enriched stream from a conventional air separation process to the bottom of a column having a reflux condenser. Liquid nitrogen is withdrawn from an upper portion of the column and flashed to generate a liquid and a vapor. The liquid from the flash separation is recovered and flashed a second time to produce the high purity product.

An improved process and installation to effectively carry out the production both ultra-high purity nitrogen and a normal purity nitrogen would be advantageous and is much desired.

SUMMARY OF THE INVENTION

A feature of the process in accordance with the present invention is to provide a flexible and economical method for production of nitrogen products of differing purity. The process of the invention in one sense comprises expanding a compressed and dried feed air stream into an air separation column to form at the top of the air separation column nitrogen-enriched vapor and at the bottom of the air separation column an oxygen-enriched liquid; withdrawing a portion of the nitrogen-enriched vapor from the air separation column and compressing at least a portion of the withdrawn portion to an elevated pressure to form an elevated pressure nitrogen-enriched stream comprising light impurities and traces of heavy contaminants; flowing at least a portion of the elevated pressure nitrogen-enriched stream to a second column wherein heavy contaminants are concentrated in a bottoms liquid and wherein an overhead stream substantially free of heavy contaminants is formed in the upper portion of the second column; condensing at least a portion of the overhead stream substantially free of heavy contaminants against the oxygen-enriched liquid by indirect heat exchange; withdrawing a portion of the overhead stream substantially free of heavy contaminants to form an intermediate stream substantially free of heavy contaminants and flowing at least a portion of the intermediate stream to a reboiler positioned below a stripping zone in a third column to provide boil-up for the third column and thereafter flowing at least a portion of the intermediate stream into the third column at a point above the stripping zone, and; withdrawing an ultra-high purity nitrogen product substantially free of light impurities and heavy contaminants from the third column at a point below the stripping zone. By the term "substantially free", it is meant a concentration of less than about 50 parts per billion.

The process of the present invention is also advantageous, in an alternative embodiment, to provide ultra-high purity nitrogen to usage facilities which have a relatively higher tolerance for light impurities. In such embodiments, the process of the present invention comprises expanding a compressed and dried feed air stream into an air separation column to form at the top of the air separation column nitrogen-enriched vapor and at the bottom of the air separation column an oxygen-enriched liquid; withdrawing a portion of the nitrogen-enriched vapor from the air separation column and compressing at least a portion of the withdrawn portion to an elevated pressure to form an elevated pressure nitrogen-enriched stream comprising traces of heavy contaminants; flowing at least a portion of the elevated pressure nitrogen-enriched stream to a second column wherein heavy contaminants are concentrated in a bottoms liquid and wherein a nitrogen product substantially free of heavy contaminants is withdrawn from the upper portion of the second column.

In other embodiments, the process according to the present invention further comprises production of a normal purity nitrogen product and optionally a second nitrogen product of higher purity. The higher purity stream is substantially free of heavy hydrocarbon contaminants, and in the preferred embodiment also substantially free of light impurities. The preferred embodiments of the present invention are particularly advantageous to the art of producing high purity nitrogen, among other factors, due to the expansion of feed air directly into the air separation column, and therefore the ability to operate the separation columns at relatively low pressure.

DETAILED DESCRIPTION OF THE PREFERRED EMBODIMENTS

Figure 1:
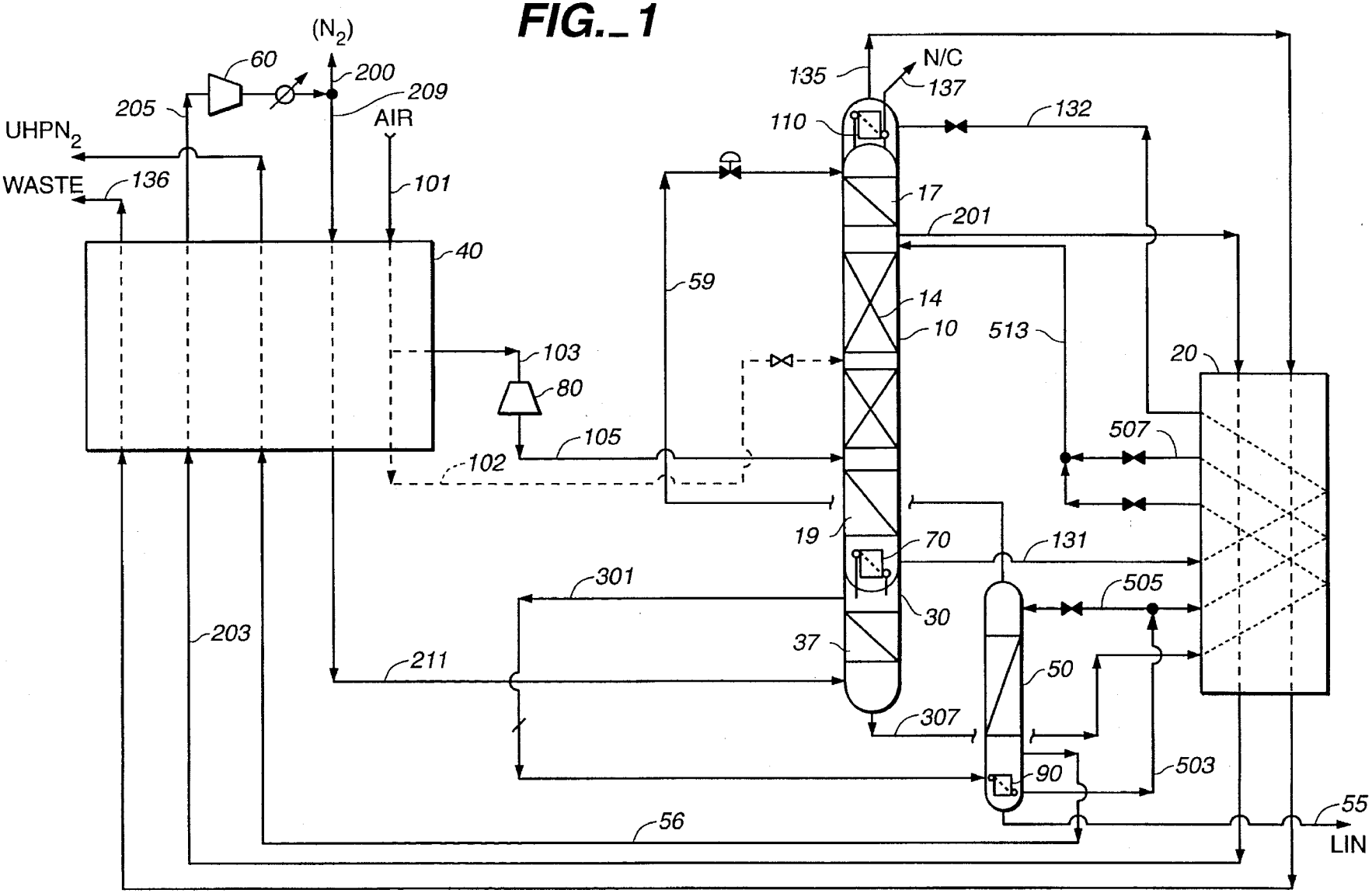
FIG. 1 represents schematically an installation for producing high purity nitrogen products substantially free of heavy contaminants and light impurities.

FIG. 1 schematically depicts various process components and process options which comprise various embodiments of the present invention. The processes and installations depicted in FIG. 1 provide for the production of extremely pure nitrogen in an integrated cryogenic environment. In the preferred embodiment, the process comprises taking compressed and dried a feed stream 101, which comprises major amounts of nitrogen and oxygen, and minor amounts of impurities and contaminants, and cooling at least a portion of the feed air in heat exchanger 40 in a heat exchange relationship with one or more other process streams. When exiting the heat exchanger 40, the cooled feed stream 103 is preferably expanded in a turbine 80 to form expanded feed stream 105 which is thereafter flowed into air separation column 10 at an intermediate point in the column between stripping zone 19 and rectifying zone 14. Preferably the column 10 is maintained between about 3 bar and about 4.5 bar absolute. The expansion of cooled feed stream 103 provides cold for liquefaction and separation of the feed air in the air separation column 10 to form at the bottom of the column an oxygen enriched liquid, and at the top of the column a nitrogen-enriched vapor. The stripping zone 19 and rectifying zone 14 may comprise any of well-known vapor-liquid contacting means, such as sieve trays, bubble cap trays, and structured or random-type packings.

Nitrogen-enriched vapor stream 201 is withdrawn from the upper portion of the column 10 and warmed against at least one other process stream in subcooler 20 and main heat exchanger 40. At least a portion of the withdrawn and warmed stream 205 is compressed in recycle compressor 60 to a pressure greater than the column 10 pressure, preferably to between about 4 bar and about 10 bar. In accordance with the process of the present invention, at least a portion of the compressed nitrogen-enriched stream is cooled in main exchanger 40 flowed to a second column, which operates at a pressure greater than the pressure of the air separation column 10, which operates preferably between about 4 bar and about 10 bar absolute. The intermediate nitrogen stream 211 enters the second column 30 at a point below a vapor liquid contacting zone 37. Nitrogen vapors rise in contacting zone 37, and at least a portion of the rising nitrogen vapors are condensed against cooler oxygen-enriched liquid contained in the bottom of air separation column 10 in condenser 70. Condensed nitrogen vapors are returned to the upper portion of the second column 30, and descend downward through contacting section 37 whereby heavy contaminants which may comprise carbon monoxide, argon, residual oxygen, and heavier hydrocarbons are absorbed from the nitrogen vapors into the descending liquid and are concentrated in the bottom of the second column 30. A portion of the liquid nitrogen concentrated in heavy contaminants is removed form the bottom of the second column 30, and preferably cooled and expanded, and thereafter flowed to the air separation column 10, where it is preferably fed to column 10 at an intermediate location. By the term "heavy contaminants", it is meant constituents which are less volatile than nitrogen, and by the term "light impurities" it is meant those constituents which are more volatile than nitrogen. Typical heavy contaminants include oxygen, carbon monoxide, argon, hydrocarbon compounds, krypton, xenon, carbon dioxide and water. Typical light impurities include hydrogen, helium and neon.

In accordance with the embodiments of FIG. 1, a nitrogen-enriched stream substantially free of heavy contaminants is withdrawn from the upper portion of the second column in conduit 301 and flowed to a third column, which is preferably operated at a pressure between that of the column 10 and the second column 30, preferably between about 3.5 bar and 9 bar absolute, wherein light impurities are distilled from the nitrogen stream 301 in a stripping zone. Preferably, the nitrogen feed stream 301 is flowed through a reboiler 90 located in the lower portion of column 50 to provide boil-up for the column, and thereafter at least a portion of the feed stream exiting from condenser 90 is expanded into column 50 at a point above a vapor-liquid contacting zone, wherein light impurities remain in rising vapors and are concentrated in a vapor stream 59 removed from column 50 and optionally expanded into an upper location in air separation column 10. A vapor stream above reboiler 90, and a liquid accumulation below reboiler 90 in column 50, substantially free of both heavy contaminants and light impurities, is thus available, as ultra-pure gaseous nitrogen in conduit 56, and optionally liquid nitrogen in stream 55. Gaseous ultra-pure nitrogen withdrawn in conduit 56 is warmed in heat exchanger 40 and made available to the gas user requiring extremely high purity nitrogen product.

Referring now again to the air separation column 10 of FIG. 1, in preferred embodiments oxygen-enriched liquid is withdrawn via line 131 from below the contacting zone 19, cooled against other process streams in subcooler 20 from which it flows via line 132, and expanded into the top condenser area of column 10 where it vaporizes to condense in heat exchanger 110 at least a portion of the nitrogen-enriched vapors rising in the upper portion of the column. Following condensation in condenser 110, nitrogen condensation is returned to the column as reflux, and vaporized oxygen-enriched stream exits the top condenser area and after being warmed against other steams in heat exchangers 20 and 40, flows from the system as a mixed waste stream 136. A purge stream comprising non-condensible gases, which may include light impurities derived from column 50 and redelivered to the air separation column 10 via conduit 59, may be withdrawn from condenser 110 via conduit 137 and removed from the system.

In alternative embodiments, referring still to FIG. 1, a normal purity gaseous nitrogen product may also be taken from the nitrogen-enriched recycle stream, preferably derived from a portion of the discharge stream from recycle compressor 60 depicted in FIG. 1 as stream 200. In this embodiment, the remaining portion of the compressed nitrogen-enriched recycle not taken as normal purity nitrogen product is flowed via stream 209 to be again cooled and flowed to column 30 as described earlier. In another embodiment, liquid nitrogen product substantially free of heavy contaminants and light impurities is produced from the bottom of column 50 via line 55 to usage or storage. In any of the various embodiments depicted in FIG. 1, a portion of the intermediate nitrogen-enriched stream 503 free of heavy contaminants exiting reboiler 90 in column may be diverted from flowing to column 50 as feed, and instead be cooled and expanded into an upper portion of the air separation column 10.

Figure 2:
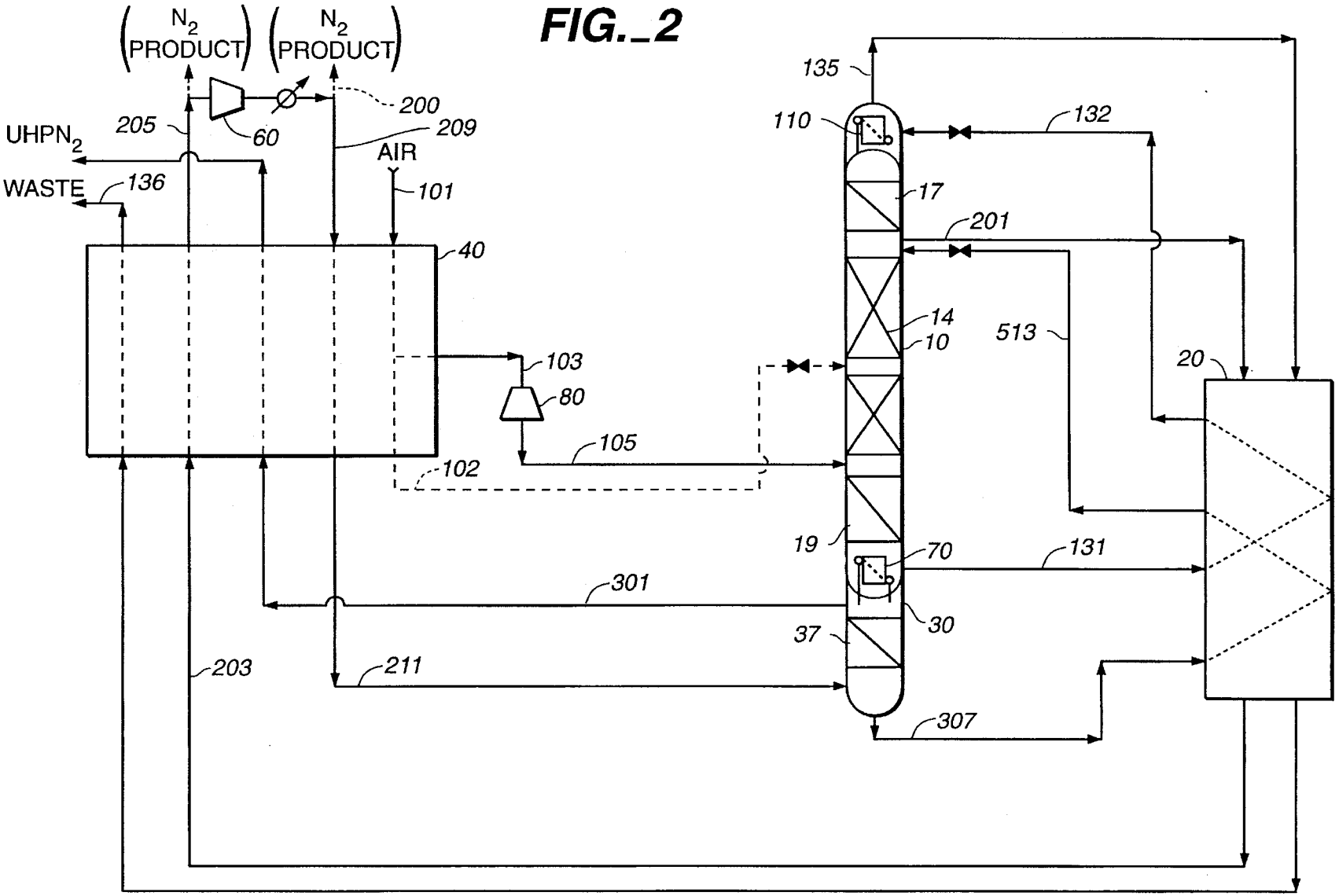
FIG. 2 represents schematically further embodiments of the present invention to enable production of high purity nitrogen products.

Referring now to the embodiment depicted in FIG. 2, in situations where the nitrogen user requirements do not necessitate substantially complete removal of light impurities, in accordance with further aspects of the present invention it is possible to produce a nitrogen product substantially free of heavy contaminants, while containing amounts of light impurities on the order of the nitrogen-rich stream withdrawn from the main column 10. As depicted in FIG. 2, a nitrogen product is produced directly from the upper portion of the column 20. The process comprises expanding a compressed and dried feed air stream into an air separation column to form at the top of the air separation column nitrogen-enriched vapor and at the bottom of the air separation column an oxygen-enriched liquid; withdrawing a portion of the nitrogen-enriched vapor from the air separation column and compressing at least a portion of the withdrawn portion to an elevated pressure to form an elevated pressure nitrogen-enriched stream comprising heavy contaminants; flowing at least a portion of the elevated pressure nitrogen-enriched stream to a second column wherein heavy contaminants are concentrated in a bottoms liquid and wherein a nitrogen product substantially free of heavy contaminants is withdrawn from the upper portion of the second column. With this embodiment, the advantages of the embodiments depicted in FIG. 1 are retained, while lessening the capital cost associated with a third column.

Also to provide process flexibility and maintain efficiency during varying product demands, in further embodiments, a portion of the cooled feed air flowed to the main heat exchanger 40 in stream 101 may be diverted from the turbine 80, and instead be further cooled, and flowed to the column 10 via line 102, and expanded into the column at an intermediate location, preferably intermediate in the rectification zone 14. In this manner, the operating temperature of the expander can be properly controlled to result in optimum performance.

The present invention has been described with reference to various alternative embodiments, and for the sake of convenience represented on two Figures. However, the scope of the invention, including the various preferred and alternative embodiments, is to be construed only from the claims presented below.

I claim:

1. In a process for producing a nitrogen product from the cryogenic separation of air in a first distillation column wherein a feed air stream is compressed, cooled by indirect heat exchange and expanded to produce a feedstream at about the dew point of the feedstream which is separated into a nitrogen-enriched vapor overhead and an oxygen-enriched bottoms liquid, wherein a nitrogen-enriched vapor stream is withdrawn from the upper portion of the first distillation column, rewarmed and compressed to an elevated pressure; the improvement to produce ultra-pure nitrogen which comprises:

recycling at least a portion of the compressed withdrawn nitrogen-enriched stream to the bottom portion of a second column operating at a higher pressure than the first distillation column to produce an overhead stream substantially free of heavy contaminants and condensing at least a portion of the overhead stream substantially free of heavy contaminants by indirect heat exchange against at least a portion of the oxygen-enriched bottoms liquid;

withdrawing a portion of the overhead stream substantially free of heavy contaminants from the second column;

flowing at least a portion of the withdrawn overhead stream substantially free of heavy contaminants from the second column to a reboiler located below a stripping zone in a third column where it at least partially condenses to form a condensed stream substantially free of heavy contaminants and flowing at least a portion of the condensed stream substantially free of heavy contaminants into the third column at a point above the stripping zone, and;

withdrawing an ultra-high purity nitrogen product substantially free of light impurities and heavy contaminants from the third column.

2. A process for the production of ultra-high purity nitrogen products, comprising the steps of:

(a) expanding a compressed and dried feed air stream into a first distillation column to form at the top of the first distillation column nitrogen-enriched vapor and at the bottom of the first distillation column an oxygen-enriched liquid comprising light impurities and heavy contaminants;

(b) withdrawing a portion of the nitrogen-enriched vapor from the column and compressing at least a portion of the withdrawn portion to an elevated pressure to form an elevated pressure nitrogen-enriched stream;

(c) flowing at least a portion of the elevated pressure nitrogen-enriched stream to the bottom portion of a second column wherein heavy contaminants are concentrated in the bottom of the second column and wherein a nitrogen vapor substantially free of heavy contaminants is formed in the upper portion of the second column;

(d) condensing at least a portion of the nitrogen vapor substantially free of heavy contaminants against oxygen-enriched liquid by indirect heat exchange;

(e) withdrawing a portion of the nitrogen vapor to form an intermediate stream substantially free of heavy contaminants and flowing at least a portion of the intermediate stream to a reboiler positioned below a stripping zone in a third column to provide boil-up for the third column and thereafter flowing at least a portion of the intermediate stream into the third column at a point above the stripping zone, and;

(f) withdrawing an ultra-high purity nitrogen product substantially free of light impurities and heavy contaminants from the third column from a point below the stripping zone.

3. The process as recited in claim 2 further comprising removing a portion of the elevated pressure nitrogen-enriched stream as normal purity nitrogen product.

4. The process as recited in claim 2 wherein the first distillation column further comprises a vapor-liquid contacting zone positioned above the withdrawal point of nitrogen-enriched vapor and further comprising flowing a nitrogen stream comprising light impurities withdrawn from above the stripping zone in the third column to the air separation column as reflux for the first distillation column.

5. The process as recited in claim 2 wherein at least a portion of the oxygen-enriched liquid is withdrawn from the first distillation column, cooled by indirect heat exchange against at least a portion of the withdrawn nitrogen-enriched stream and thereafter utilized to condense at least a portion of the nitrogen-enriched vapors at the top of the first distillation column in a condenser to provide reflux for the first distillation column.

6. The process as recited in claim 5 further comprising purging vapors containing non-condensibles from the condenser at the top of the first distillation separation column.

7. The process as recited in claim 2 further comprising producing an ultra-pure liquid nitrogen product from liquid accumulated in the bottom of the third column.

8. The process as recited in claim 2 further comprising cooling at least a portion of the intermediate stream substantially free of heavy contaminants against at least a portion of the withdrawn nitrogen-enriched stream from the first distillation column and flowing the portion of the intermediate stream to the upper portion of the first distillation column.

9. The process as recited in claim 2 wherein the expansion of the compressed and cooled feed air is in an expansion turbine from which turbine at least a portion of the expanded feed air stream is flowed directly to the first distillation column.

10. The process as recited in claim 9 further comprising withdrawing a portion of the oxygen-enriched bottoms stream from the first distillation column and flowing to a condenser where the portion of the oxygen-enriched bottoms stream is utilized to condense at least a portion of the nitrogen-enriched vapor overhead by indirect heat exchange.

11. The process as recited in claim 9 wherein the operating pressure of the first distillation column is at least 20 psi less than the pressure of the second column.

12. The process as recited in claim 2 wherein substantially all of the at least a portion of the nitrogen vapor substantially free of heavy contaminants condensed against the oxygen-enriched liquid by indirect heat exchange is returned to the second column as reflux.

13. The process as recited in claim 2 wherein the operating pressure of the first distillation column is between about 3 bar and about 4.5 bar and the pressure of the second column is between about 4 bar and about 10 bar.

14. The process as recited in claim 2 wherein the compressed and dried feed air stream comprises feed air cooled in an inlet heat exchanger, and wherein the expansion is in a turbine.

15. The process as recited in claim 2 further comprising further cooling a portion of the feed air to a temperature less than the temperature of the portion of the compressed and dried feed air stream at the inlet to the turbine, and flowing the further cooled portion to the first distillation column where it is expanded into the column.

16. A process for the production of at least one ultra-high purity nitrogen product, comprising the steps of:

(a) expanding a compressed and dried feed air stream into an air separation column to form at the top of the first distillation column nitrogen-enriched vapor and at the bottom of the first distillation column an oxygen-enriched liquid;

(b) withdrawing a portion of the nitrogen-enriched vapor from the air separation column and compressing at least a portion of the withdrawn portion to an elevated pressure to form an elevated pressure nitrogen-enriched stream comprising heavy contaminants;

(c) flowing at least a portion of the elevated pressure nitrogen-enriched stream to a second column the lower portion of wherein heavy contaminants are concentrated in a bottoms liquid and wherein a nitrogen vapor substantially free of heavy contaminants is formed in the upper portion of the second column;

(d) condensing at least a portion of the nitrogen vapor substantially free of heavy contaminants against the oxygen-enriched liquid by indirect heat exchange;

(e) recovering as a product at least a portion of the nitrogen vapor substantially free of heavy contaminants.

17. The process as recited in claim 16 wherein at least a portion of the oxygen-enriched liquid is withdrawn from the first distillation column, cooled by indirect heat exchange with at least a portion of the withdrawn nitrogen-enriched stream and utilized to condense at least a portion of the nitrogen-enriched vapors at the top of the first distillation column in a condenser to provide reflux for the first distillation column.

18. The process as recited in claim 16 wherein the expansion of the compressed and cooled feed air is in an expansion turbine from which turbine at least a portion of the expanded feed air stream is flowed directly to the first distillation column.

19. The process as recited in claim 18 wherein the operating pressure of the first distillation column is at least 20 psi less than the pressure of the second column.

20. The process as recited in claim 16 further comprising further cooling a portion of the feed air to a temperature less than the temperature of the portion of the compressed and dried feed air stream at the inlet to the turbine, and flowing the further cooled portion to the first distillation column where it is expanded into the column.

* * * * *